United States Patent [19]

Schuurman et al.

[11] 4,257,760

[45] Mar. 24, 1981

[54] CYCLONE BURNERS

[76] Inventors: Hubert G. Schuurman, 2 Bray St., Darfield; James B. Stott, 138 Totara St.; Ian A. Gilmour, 9 Sunvale Ter., both of Christchurch, all of New Zealand

[21] Appl. No.: 983

[22] Filed: Jan. 4, 1979

[30] Foreign Application Priority Data

Jan. 11, 1978 [NZ] New Zealand ..... 186193

[51] Int. Cl.[3] ..... F23C 5/32

[52] U.S. Cl. ..... 431/158; 431/173; 431/284

[58] Field of Search ..... 431/158, 173, 384

[56] References Cited

U.S. PATENT DOCUMENTS

| | | | |
|---|---|---|---|
| 2,930,194 | 3/1960 | Perkins | 431/158 |
| 3,039,406 | 6/1962 | Aref | 431/173 |
| 3,363,661 | 1/1968 | Horton | 431/158 |
| 3,597,141 | 8/1971 | Fracke | 431/173 |
| 3,615,247 | 10/1971 | Steeves | 431/158 |
| 3,729,285 | 4/1973 | Schwedersky | 431/284 |
| 3,846,066 | 11/1974 | Ebeling et al. | 431/158 |
| 4,104,017 | 8/1978 | Alin | 431/173 |

*Primary Examiner*—Joseph Man-Fu Moy
*Attorney, Agent, or Firm*—Holman & Stern

[57] ABSTRACT

A cyclone burner in which an air/fuel mixture is admitted through one or more ports located close to the throat through which combustion products escape from the burner, and additional air is admitted through one or more inlets located closer to the throat than said port or ports. The air/fuel mixture is admitted such that it moves tangentially to the curved internal wall of the burner, and the additional air is admitted such that it moves generally tangential to the direction of the combustion products travelling towards the throat, and towards one of the air/fuel ports.

18 Claims, 3 Drawing Figures

CYCLONE BURNERS

BRIEF SUMMARY OF THE INVENTION

The present invention relates to cyclone burners, that is, burners of the type in which a mixture of air and fuel is circulated at high velocity in a generally spiral path around a combustion chamber.

Cyclone burners have been known for many years, see for example U.K. Pat. No. 552747 to Babcock and Wilcox Limited, which discloses a number of different cyclone burner designs, all of which include a primary stream of air plus solid fuel fed into a circular combustion chamber at high velocity in a path tangential to the burner wall. Additional air is fed in in the same manner, so that it matches the primary stream.

However, known designs of cyclone burners have proved in practice to operate with a greater slag emission than predicted theoretically, and to suffer badly from abrasion of the combustion chamber lining by incoming fuel and air.

An object of the present invention is the provision of a cyclone burner which can burn solid, liquid or gaseous fuels efficiently, with a minimum of noxious waste gases and ash emission, and which does not suffer from undue abrasion of the combustion chamber.

The present invention provides a cyclone burner comprising: a substantially cylindrical combustion chamber of circular or elliptical internal cross-section; a throat for conveying combustion products from the combustion chamber; one or more ports in the curved internal wall of the chamber, for the entry of an air/fuel mixture into said chamber, the or each said port being located close to the throat and being angled such that in use the air/fuel mixture admitted therethrough is approximately tangential to the curved internal wall of the chamber; and one or more air inlets, the or each said air inlet being located closer to the throat than said port or ports, and being arranged to admit in use to the combustion chamber a stream of air the direction of which is generally tangential to that of the combustion products moving towards the throat and is directed so as to convey some of said combustion products towards the or an air/fuel entry port; the number of said ports and said air inlets being governed by the internal diameter of the combustion chamber, as hereinbefore described.

A cyclone burner having a single air/fuel port is feasible only for very small-scale burners e.g. up to about 150 mm internal diameter of the combustion chamber. If the burner is scaled up much beyond this size, multiple air/fuel ports must be used, to prevent an unacceptably high erosion rate of the refractory lining by the impact of the high velocity stream of air/fuel mixture. If multiple air/fuel ports are used, the impact of a given volume of air/fuel mixture on the refractory lining is spread over a number of areas of the lining rather than being concentrated on a single area. In addition combustion is more efficient if multiple ports are used, because this increases the surface-to-volume ratio of the unburnt fuel region at the point where the air/fuel mixture enters the burner, and this gives greater radiation heat transfer to the unburnt fuel, and so promotes ignition. From the point of view of reducing refractory erosion and promoting ignition, the greater the number of air/fuel ports used, the better, but in practice the maximum number of ports is limited by the size of the combustion chamber and by considerations of cost.

Preferably, the number of air inlets is equal to the number of air/fuel ports, and both air inlets and air/fuel ports are equidistantly spaced apart. Preferably, each air/fuel port is paired with an air inlet.

The effect of the or each air inlet is to increase the swirl of the combustion gases in the chamber, and, more importantly, to blow back towards the or each air/fuel port, the very hot gases about to leave through the throat, thus greatly assisting the early combustion of fuel entering through the port(s).

DETAILED DESCRIPTION

Figure 1:
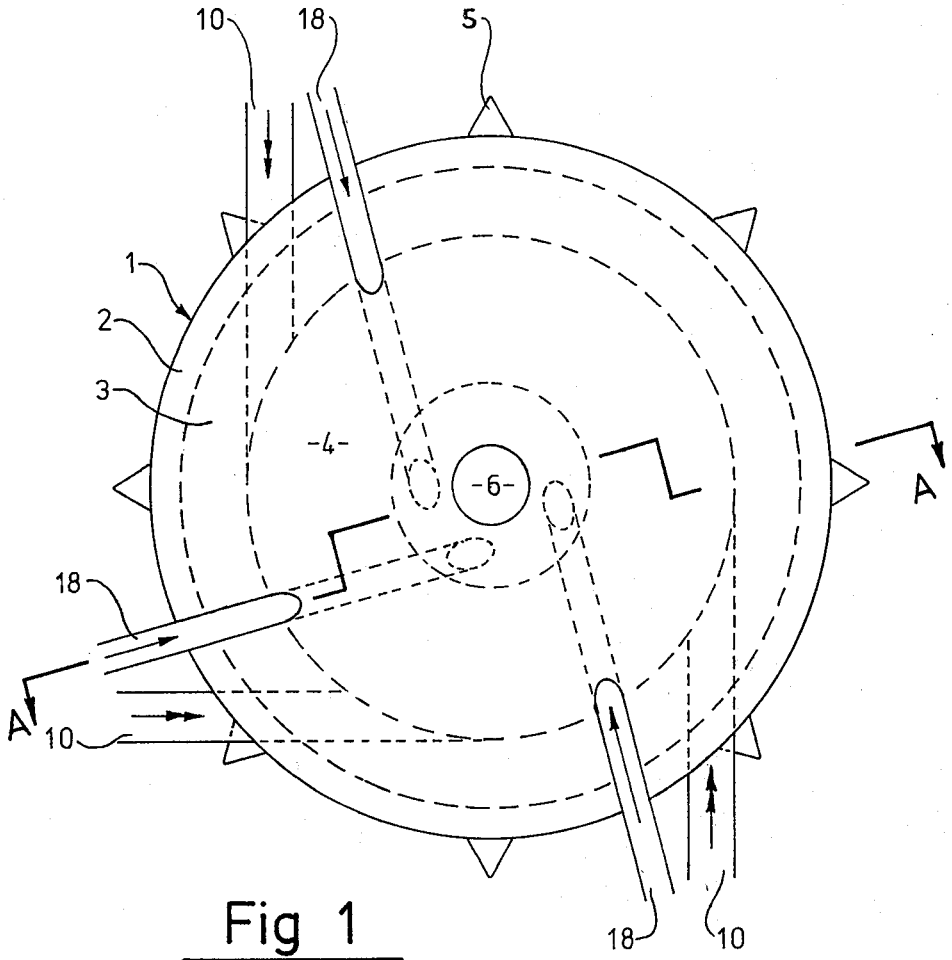
FIG. 1 shows a plan view of a cyclone burner in accordance with the present invention; this burner has eight air/fuel ports and eight air inlets, but for clarity only three of said ports and inlets are shown.
Figure 2:
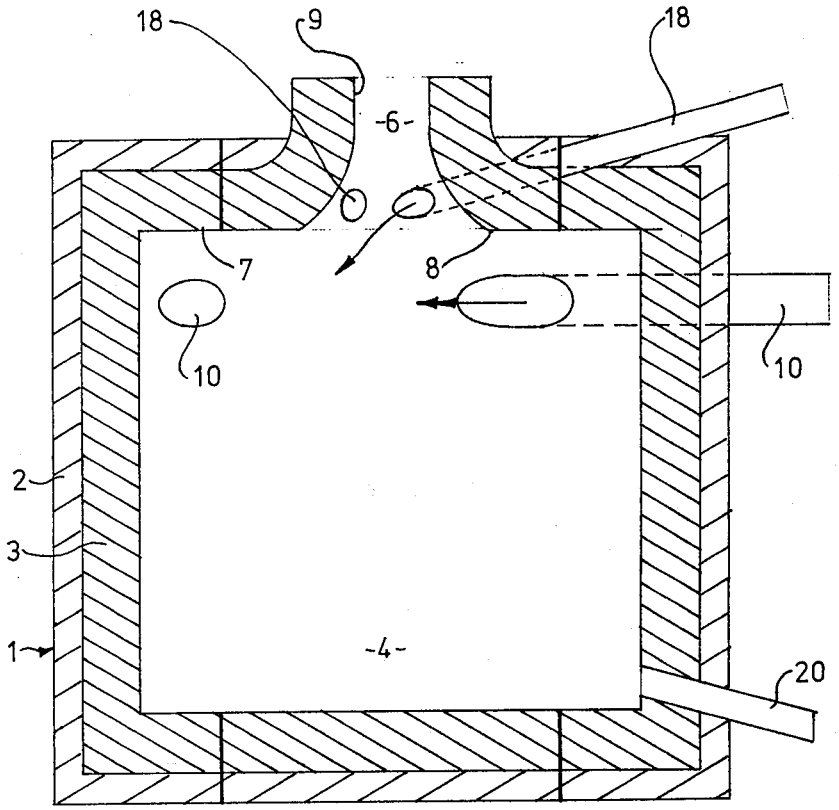
FIG. 2 shows a section on line A—A of FIG. 1.

The burner shown in FIGS. 1 and 2 comprises a cylindrical steel shell 1 lined with an insulating layer 2 and a layer of suitable refractory material 3 (e.g. a mouldable high-alumina refractory). The inner surface of the refractory material 3 forms the wall of the combustion chamber 4, and is circular in cross-section, having an internal diameter of 600 mm. Most presently-available refractory materials need to be cooled to ensure a sharp temperature gradient through the thickness of the refractory wall and so prevent rapid erosion of the refractory in service. This cooling may be achieved by pipes set in the refractory layer, through which pipes a cooling fluid is circulated when the burner is in use. Alternatively, the refractory may be cooled by drawing air over the surface of the shell, which preferably is formed with longitudinal ribs 5 to increase the efficiency of heat transfer. The air drawn over the shell 1 may be fed into the burner so that cooling the refractory also preheats the burner feed air. When some or all of this air is not needed for the burner, the excess may be fed directly into e.g. the heat-exchanger which receives the burner combustion products.

A throat 6 through which the combustion products escape in use is formed in the centre of one end wall 7 of the combustion chamber. The throat 6 is circular in cross-section and is lined with the same refractory material as the combustion chamber. FIG. 2 shows the throat as tapering from the start 8 of the throat inwards to the end 9 of the throat projecting beyond the end wall of the shell 1. However, this shape is not essential: the only essential requirements for the throat are that the shape of the throat allows each air inlet 18 to be as close as possible to the corresponding fuel entry port 10 (for reasons explained below); and that the diameters of the throat throughout its length are such that the combustion products can pass out of the combustion chamber at a velocity sufficiently low to prevent excessive pressure, or noise, or unacceptable abrasion of the throat. For example, with a combustion chamber of 600 mm interval diameter, a throat having a minimum diameter of 230 mm has been found satisfactory.

Figure 2A:
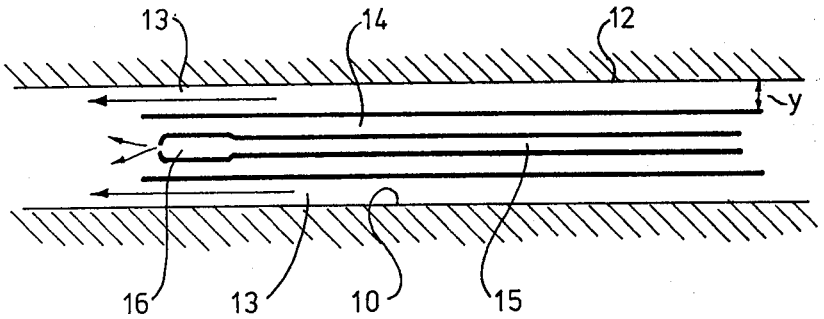
FIG. 2*a* shows a detail of FIG. 2.

Just below the start 8 of the throat 6, eight fuel/air entry ports 10 (three of which are shown) are set into the curved wall of the combustion chamber. Each fuel/air port 10 is set at an angle through said wall, such that the air/fuel mixture admitted by said port is approximately tangential to said curved wall of the combustion chamber 4 (see FIG. 1.) The burner shown in the drawings is designed to burn solid, liquid or gaseous fuel. As shown in FIG. 2*a*, each fuel/air port 10 comprises an open-ended housing 12 inside which are a pressurized air supply line 13, a pressurized air and solid fuel supply line 14, and a liquid or gaseous fuel supply line 15. If the burner is being fuelled only by liquid or gaseous fuel the supply line 14 carries air only: the burner is supplied with air through lines 13 and 14, and with fuel through line 15. Each line 15 ends in an atomising nozzle 16 which splits the incoming fuel (if liquid) into droplets, ensuring a thorough mix with the air.

If the burner is being fuelled only by solid fuel (e.g. coal or wood) a mixture of air and solid fuel particles is fed into the burner through line 14, together with air through line 13. Each of the solid fuel particles has a diameter not greater than one-sixth of the dimension y (see FIG. 2*a*). Said air/fuel mixture is fed into the burner at a high velocity (e.g. 50 meters/second) and is ignited by burning gaseous or liquid fuel introduced through the line 15. Said gaseous or liquid fuel is ignited e.g. by electrodes (not shown) located at the end of the line 15 adjacent the burner. A temperature of about 900° C. is sufficient to ignite the solid fuel. If the burner is always to be used only for solid fuel, a liquid or gaseous supply line 15 may be fitted in only one of the housings 12.

For the burner to operate efficiently, it is essential that the air and fuel enter the combustion chamber at a velocity sufficiently high to cause the air/fuel mixture to mix thoroughly and travel in a spiral path around the chamber, so that while the fuel is burning, it passes back through the incoming air/fuel mixture, igniting the incoming fuel, before the combustion products and any unburnt fuel leave through the throat. Ideally, the air/fuel mixture should circulate around the combustion chamber until the fuel is completely burnt; it has been found that with a burner having a combustion chamber of 600 mm internal diameter, an air pressure of 5 inches water/gauge and an inlet injection velocity of 50 m/sec. give good results. Generally an increase in the air pressure (and hence in the air velocity increases the efficiency of the air/fuel mixing, and hence the combustion efficiency but liquid fuels are less sensitive in this respect than solid fuels.

It is thought that locating the air/fuel ports 10 close to the throat 6 causes the air/fuel mixture, on entering the combustion chamber 4 to spiral downwards to the bottom of the chamber and then spiral upwards again, past the ports 10, before leaving through the throat.

In addition to the air supplied through the lines 13 and 14, air is also supplied through air inlets 18 equal in number to the ports 10. Said inlets 18 are arranged to supply pressurized air into the burner at or near the start 8 of the throat 6 for the whole period of operation of the burner. The stream of air through each inlet 18 increases the swirl of combustion gases, and so helps to improve combustion. Also, each air inlet 18 is slanted so that the stream of air is tangential or near-tangential to, and just outside of, the stream of combustion gases passing into the throat 6 when the burner is in use, and each inlet 18 is directed toward one of the air/fuel ports 10, so that the effect of the air stream through the inlet 18 is to blow back towards the ports 10 very hot gases about to leave through the throat, ensuring early combustion of the entering fuel. The air inlets 18 should be close to the air/fuel ports 10 so that the air stream through each inlet 18 is still concentrated when it strikes the combustion gases. The inlets 18 need not be located in the throat itself, but can be located in the end wall of the burner, providing they fulfill the criteria discussed above.

The burner described above, fuelled with diesel oil, would operate at about 1200° C. or higher if required, and produce carbon dioxide, steam, oxygen and nitrogen as exhaust gases, with some sulphur contamination if sulphur is present in the oil. In use, the hot exhaust gases are ducted from the throat to wherever they are needed e.g. a heat- exchanger.

The above described burner fuelled with solid fuel would operate at around 1500° C. The burner will burn finely-divided solids (e.g. coal dust, sawdust) efficiently but it is not necessary to use finely divided solid fuels the particle size of the fuel is governed simply by the size of the fuel supply line 14. Any ash produced by the solid fuel is melted and can be removed as a slag, the burner being provided with means for removing the slag at intervals or continuously throughout combustion e.g. by providing a slag exit channel 20 in the bottom of the combustion chamber or by mounting the burner in a tilted position so that as slag accumulates it trickles out of the throat, or by tipping the burner periodically.

If the hot combustion gases emerging from the throat are found to contain an unacceptably large proportion of nitrogen oxides this proportion can be greatly reduced by running the burner 'rich' (i.e. with an excess of fuel). The combustion gases are then cooled, and further air is added to complete combustion of said gases at a lower temperature.

A burner of 600 mm internal diameter can produce 1.5 megawatt, and it is thought that further scaling-up to a combustion chamber internal diameter of about 1.3 m (approx 15 megawatt) is possible. When the burner is scaled-up, the air/fuel entry ports 10 and the air inlets 18 are not increased proportionately in size, but the number of said ports and inlets is increased. The use of a large number of small air/fuel ports 10 rather than one large port reduces the erosion of the refractory lining 3 of the burner caused by the impact on the refractory of large volumes of air/fuel mixture travelling at a high velocity. Also, using a large number of air/fuel ports 10 promotes ignition of the fuel, as discussed above. A very small burner (e.g. internal diameter 150 mm) will operate satisfactorily with only a single air/fuel port 10, without undue refractory abrasion and with reasonable efficiency. However, if the burner is scaled-up to (for example) an internal diameter of 600 mm, the number of air/fuel ports 10 and air inlets 18 should be increased to about 8.

It appears that scaling-up beyond 1.3 m diameter is limited by the fact that for efficient and near-complete combustion, the air/fuel mixture to be burnt must enter the combustion chamber at a high velocity, to ensure thorough air/fuel mixing. As the size of the chamber is increased, the velocity of the mixture must be maintained to achieve the required 'cyclone' effect. Also, the volume of the incoming mixture increases in proportion to the volume of the combustion chamber. The combustion products leaving the combustion chamber will, of course, undergo an increase in volume directly proportional to that of the incoming mixture, but the area of the throat through which these gases must escape cannot be increased at the same rate as the volume of the combustion chamber, so that the combustion products must pass through a throat which, as the volume of the combustion chamber is increased, becomes relatively smaller in area, resulting in constriction of the combustion products and a consequent increase in their velocity. Eventually, a point is reached at which the velocity of the combustion products through the throat results in an unacceptably high pressure loss and is too noisy and too abrasive of the throat.

However, it will be appreciated that more power can be produced from a burner of any given size, without increasing the size of the burner, by increasing the pressure at which the burner operates. In this case, the velocity of the inlet gases and fuel, and of the combustion gases, is not increased, but the pressure of said gases is increased.

What we claim is:

1. A cyclone burner comprising: a substantially cylindrical combustion chamber of circular or elliptical internal cross-section; a throat for conveying combustion products from the combustion chamber; at least one port in the curved internal wall of the chamber for the entry of an air/fuel mixture into said chamber, each said port being located close to the throat and entering said chamber at an angle such that in use the air/fuel mixture admitted therethrough is approximately tangential to the curved internal wall of the chamber; and at least one air inlet, each said air inlet being located closer to the throat than said port, and being arranged to admit in use to the combustion chamber a stream of air in a direction which is generally tangential to that of the combustion products moving towards the throat, and is directed so as to convey some of said combustion products towards each said air/fuel port; the number of said ports and said air inlets being governed by the internal diameter of the combustion chamber.

2. A cyclone burner as claimed in claim 1 wherein said burner has multiple air/fuel ports and the number of air inlets is equal to the number of ports.

3. A cyclone burner as claimed in claim 2 wherein each air/fuel port is paired with one of said air inlets such that the air stream admitted through said air inlet in use is directed to convey some of said combustion products towards the port with which it is paired.

4. A cyclone burner as claimed in claim 1 wherein each said air inlet is located in the throat.

5. A cyclone burner as claimed in claim 1 wherein each said air inlet is located in the end wall of the combustion chamber adjacent the throat.

6. A cyclone burner as claimed in claim 2 wherein each said air inlet is located in the throat.

7. A cyclone burner as claimed in claim 2 wherein each said air inlet is located in an end wall of the combustion chamber adjacent the throat.

8. A cyclone burner as claimed in claim 6 or claim 7 wherein said air/fuel ports are equidistantly spaced apart and said air inlets also are equidistantly spaced apart.

9. A cyclone burner as claimed in claim 1 wherein said throat is located in the centre of one end wall of 1he combustion chamber and is circular in cross-section.

10. A cyclone burner as claimed in claim 1 wherein the external surface of said burner is formed with ribs to assist heat-exchange between said surface and a coolant gas.

11. A cyclone burner as claimed in claim 1 wherein each air/fuel port includes a supply line for air and a separate supply line for a fluid fuel, and ignition electrodes disposed at the end of said fluid fuel line adjacent said combustion chamber.

12. A cyclone burner as claimed in claim 11 wherein said fluid-fuel line is provided with an atomizing nozzle for atomizing liquid fuels.

13. A cyclone burner as claimed in claim 11 wherein each air/fuel port further includes a supply line for a mixture of air and solid fuel particles.

14. A cyclone burner as claimed in any one of claims 11-13 wherein said air, fluid-fuel and air-and-solid-fuel supply lines are concentric.

15. A cyclone burner as claimed in claim 2 wherein each of said air/fuel ports includes a supply line for air, a further supply line for a mixture of air and solid fuel particles, and at least one of said ports further includes a separate supply line for a fluid fuel, said fluid-fuel line being provided with an atomizing nozzle, and ignition electrodes disposed adjacent the outlet of each said nozzle.

16. A cyclone burner as claimed in claim 15 wherein said combustion chamber is provided with a slag exit channel for removing slag from said chamber.

17. A cyclone burner as claimed in claim 15 further comprising support means arranged to support the burner in a tilted position such that in use slag can run out of the throat.

18. A cyclone burner as claimed in claim 1 or claim 3 wherein said burner is adapted to be operable in a pressurized system.

* * * * *